US005111174A

United States Patent [19]

Kriz

[11] Patent Number: 5,111,174

[45] Date of Patent: May 5, 1992

[54] SHIELDED HIGH FREQUENCY POWER TRANSFORMER

[75] Inventor: J. Stanley Kriz, Fairfax, Va.

[73] Assignee: AVP/Megascan, Littleton, Mass.

[21] Appl. No.: 555,041

[22] Filed: Jul. 16, 1990

[51] Int. Cl.[5] ..... H01F 15/04

[52] U.S. Cl. ..... 336/73; 336/84 C; 336/178

[58] Field of Search ..... 336/84 R, 84 C, 73, 336/178

[56] References Cited

U.S. PATENT DOCUMENTS

| | | | |
|---|---|---|---|
| 1,717,347 | 6/1929 | Camilli | 336/84 C |
| 2,463,778 | 3/1949 | Kellogg | 336/73 X |
| 2,714,710 | 8/1955 | Bradley | 336/84 C |
| 3,142,029 | 7/1964 | Keen, Jr. et al. | 336/84 C |
| 3,215,961 | 11/1965 | Dortort | 336/73 |
| 3,327,268 | 6/1967 | Rabus | 336/84 C |
| 3,387,243 | 6/1968 | Carpenter et al. | 336/84 C |
| 3,538,470 | 11/1970 | Crugnola | 336/84 C |
| 3,602,857 | 8/1971 | Robin | 336/84 C |
| 3,781,639 | 12/1973 | Peschel | 336/84 C |
| 4,031,459 | 6/1977 | Moeller et al. | 326/84 C |

*Primary Examiner*—Thomas J. Kozma
*Attorney, Agent, or Firm*—Stephen G. Matzuk

[57] ABSTRACT

A high frequency power transformer having a multi-element magnetic shield conforming to the surface of the structure including provisions for specific features of the magnetic circuit and winding assembly. The winding is disposed on one side of a four-sided magnetic circuit and is partially surrounded by a close fitting electrically continuous loop. The winding assembly includes an area having a higher electrostatic field and is surrounded by a second electrically continuous loop which is spaced apart from the winding assembly, providing significant electrostatic shielding and air movement over the winding assembly while avoiding arcing between the shield and the winding assembly due to the high electrostatic field.

5 Claims, 2 Drawing Sheets

SHIELDED HIGH FREQUENCY POWER TRANSFORMER

FIELD OF THE INVENTION

The present invention relates to shielded inductors having high electrostatic fields present, in particular to high frequency power high voltage transformers.

BACKGROUND OF THE INVENTION

High frequency power transformers and inductors used in power supplies, such as in the power supplies for cathode ray tube (CRT) displays generally radiate strong electromagnetic fields. However, as the frequency of operation of the transformers is frequently the same as the horizontal deflection frequency of the CRT, the visible effects are frequently minimal. Unfortunately, the operating frequency of efficient power supplies can no longer keep up with the increasingly high deflection frequencies encountered in the high scanning rate ultra-high resolution CRT display. Thus, the power supplies are forced to operate at a frequency below the scanning rate of the CRT. Operating the power supply at an exact sub-multiple of the scanning frequency still causes significant distortion in the CRT image due to the radiating magnetic field of the power transformer, which dramatically increases as the frequency of operation of the power supply increases.

Heretofore, shielding of the high frequency power transformer has been largely limited to encasing the entire transformer in a tightly sealed metal box, sometimes including the drive electronics. Potential flashover (arcing) between the high voltage windings and the metal box were avoided by providing generous air spacing between the transformer and the box. However, the box shielding of electromagnetic radiation is often insufficient and requires significant area within the CRT display. Alternately, the transformer is potted in a high voltage insulating material (also typically having a high dielectric constant) to form a single, void-free structure. However, displacement current in the transformer encapsulation material such as a plastic (typically epoxy) develops a high potential on the surface, frequently arcing through the air (having a lower dielectric constant) to a surface of sufficiently different potential, such as the other side of the void or slightly spaced metal structures. Significant difficulties also arise in the manufacture of truly void-free structures.

SUMMARY OF THE INVENTION

The shielded high frequency power transformer of the present invention includes a magnetic circuit and a winding assembly disposed on magnetic circuit and having an outer surface electrostatic field of a selected electric field contour. A magnetic shield is provided and comprises a plurality of electrically continuous magnetic loops which closely conforms to the magnetic circuit and a portion of the winding assembly, departing from the surface of the winding assembly for areas of increasing electric field. An air and epoxy (plastic) dielectric is provided and increased in thickness in the areas of high electric fields.

One embodiment of the present invention provides a first electrically continuous loop surrounds in close proximity with the winding assembly in areas of relatively low electrostatic fields. A second electrically continuous loop surrounds the winding assembly in areas of higher electrostatic fields, and includes sufficient spacing from the winding to prevent electrical breakdown of the intervening dielectric (e.g. air, epoxy, etc.). Thus, the high frequency power transformer can be maximally shielded by selected contouring of the electric field gradient in combination with the correspondingly selected number, shaping and spacing of the surrounding electrically continuous loops.

Additionally, the variations of size and disposition of the shield loops effects enhanced cooling of the transformer by providing a distributed heat sink thereon.

BRIEF DESCRIPTION OF THE DRAWING

These and further features of the present invention will be better understood by reading the following Detailed Description, taken together with the Drawing, wherein.

DETAILED DESCRIPTION OF THE INVENTION

Figure 1:
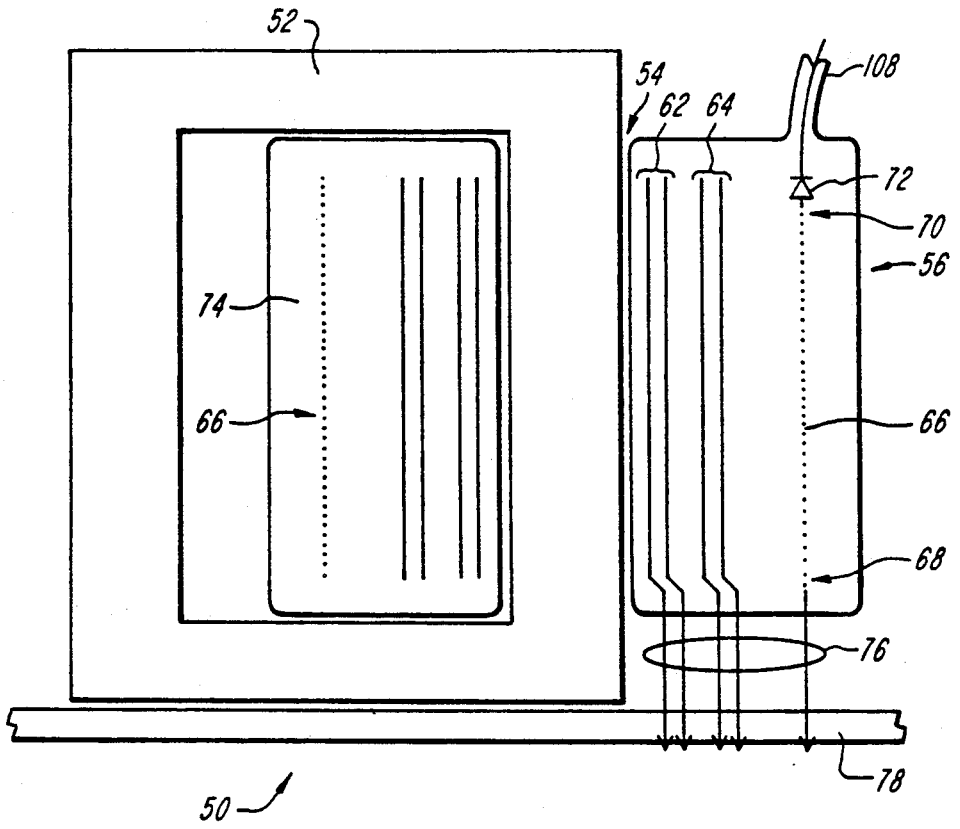
FIG. 1 is a cross section of the magnetic circuit and the winding assembly according to one embodiment of the present invention.

The cross-section 50 of FIG. 1 shows the magnetic circuit 52 extending through an aperture 54 of a cylindrical winding assembly 56 which extends over substantially the entire length of one leg of a rectangular magnetic circuit 52. The winding assembly 56 includes a primary 62 and one or more low voltage windings 64, and a high voltage secondary 66 spaced apart from the other windings (62, 64) and wound with a linear disposition of wire over the length of the assembly 56, which in combination with the disposition of the windings 62 and 64 and magnetic circuit 52 provides a selected electric field gradient a illustrated in FIG. 1A by the plot 80 of electric field strength over the length of the winding assembly 56.

The windings 62, 64 and 66 are formed and molded within an epoxy structure 74 providing mechanical support, physical protection and limited electrical insulation. The primary 62 and low voltage winding 64 connections 76 are made at one end of the epoxy structure 74 to mate with and be supported by a printed circuit board 78. The high voltage winding 66 has a 'low voltage' end 68 at the end of the winding assembly having the connections to the printed circuit board. A 'high voltage' end 70 of the high voltage winding is connected to external circuitry or a CRT through an optional rectifier diode(s) 72, molded into the epoxy structure 74.

Figure 1A:
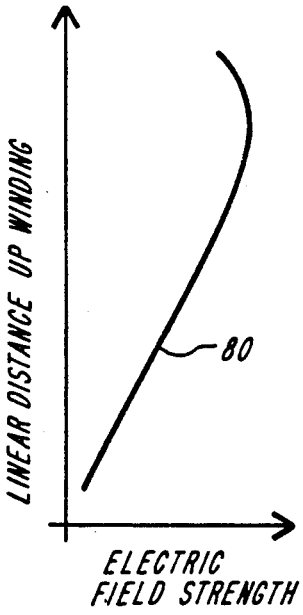
FIG. 1A is a plot of the electric field strength of the embodiment of FIG. 1.

The plot 80 in FIG. 1A of the electric field contour shows that the maximum electric field is near, but not exactly at the distal (from the connections 76) end of the winding assembly 56 of FIG. 1.

Figure 2:
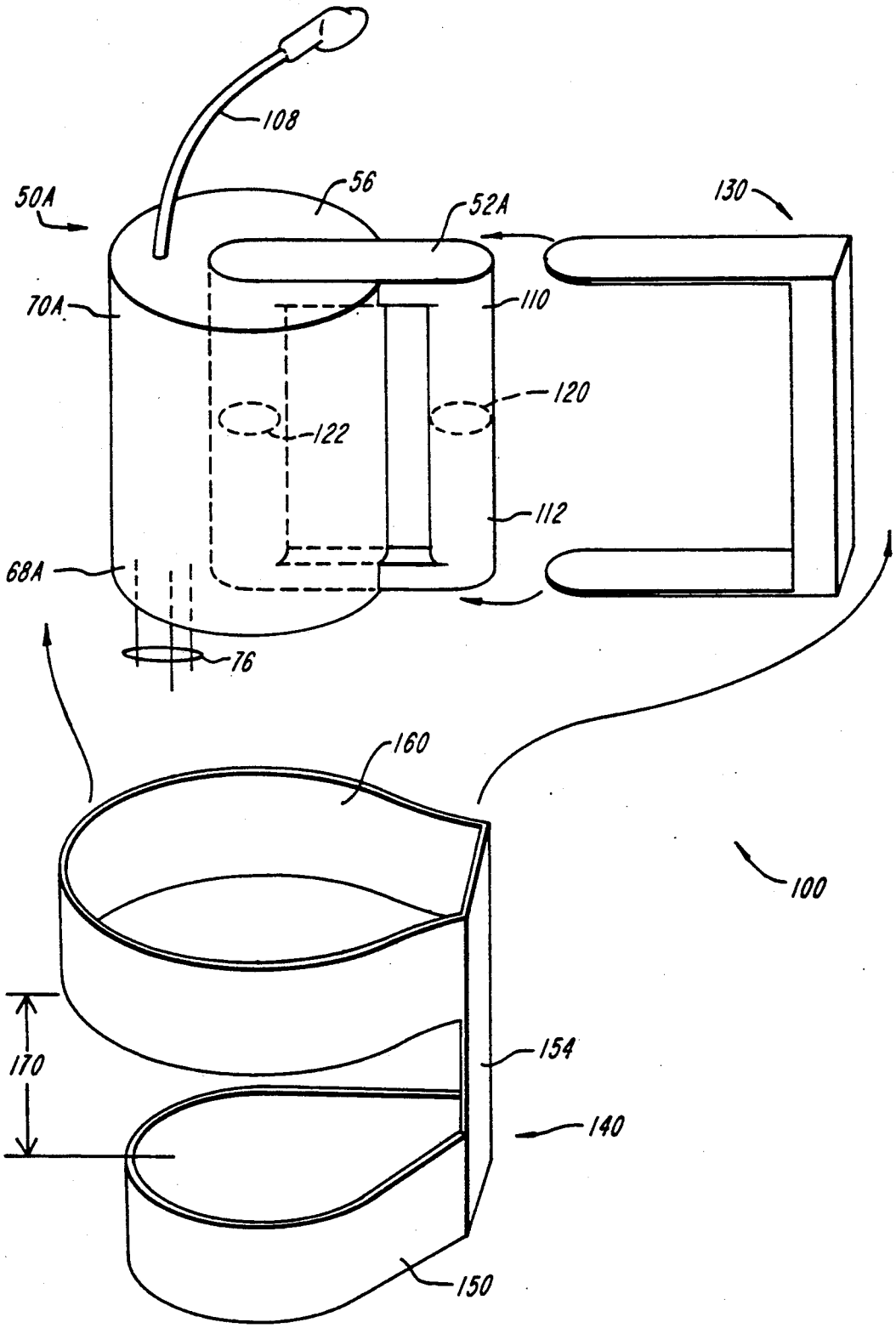
FIG. 2 is a partially exploded view of one embodiment of the shielded high frequency power transformer of the present invention.

A partially exploded view 100 of one embodiment of the shielded power supply according to the present invention is shown in FIG. 2. The transformer 50A, having the cross-section of FIG. 1., includes a magnetic circuit 52A comprising two pieces 110 and 112, of ferrite material closely joined and having a slight air gap, as desired, where joined at regions 120 and 122. An insulated lead 108 to the CRT (not shown) connects to the diode(s) 72 of FIG. 1. A generally U-shaped shield portion 130 extends around the magnetic circuit 52A, substantially entirely covering the periphery of the magnetic circuit not within the winding assembly 56, including the air gap 120.

A second magnetic shield 140 is shown having a first and second electrically continuous loops 150 and 160 of copper or other conductive material, connected by shield piece 154 and spaced apart by a selected distance 170. In one embodiment, the widths of the loops 150 and 160, and the gap 170 are each approximately ⅓ of the length of winding assembly 56. The shield 140 extends over the transformer 50A and the shield 130, wherein the first loop 150 is in close proximity to the outer surface of the winding assembly, preferably in contact therewith if the epoxy is sufficiently thick at the low voltage end 68A. The second loop 160 surrounds the high voltage end 70A and is spaced apart from the winding assembly to permit sufficient air (or other dielectric) to prevent arcing between the outer surface of the epoxy structure 74 and the second loop 160. For other electric field strength contours, the corresponding number and placement of electrically continuous loops are made with the greatest second loop 160 spacing at the highest electrical field potential. The loops 150 and 160 generally surround portions of the magnetic circuit having a total net flux of zero.

The scope of the present invention includes single winding inductors as well as multi-winding inductors and transformers which are formed to have areas of high electric fields, and further includes other magnetic circuit materials and air-core inductors and transformers. Also, materials other than epoxy and air having dissimilar dielectric coefficients are within the scope of the present invention. Further modifications and substitutions of the present invention by one of ordinary skill in the art are within the scope of the present invention, which is not to be limited except by the claims which follow.

What is claimed is:

1. A shielded inductor comprising:

a winding assembly having an aperture therethrough and an outer surface;

a magnetic circuit extending through said aperture;

a first magnetic shield substantially entirely surrounding the periphery of the portion of said magnetic circuit not extending through said winding assembly;

a second magnetic shield comprising a first electrically continuous loop in close proximity and surrounding a portion of said winding assembly outer surface, and a second electrically continuous loop laterally offset from said first electrically continuous loop and spaced apart from said winding assembly, wherein said first and second magnetic shields substantially inhibit free field electromagnetic radiation from said magnetic circuit.

2. The shielded inductor of claim 1, wherein said winding assembly comprises an area of high electrostatic field strength, and said second electrically continuous loop surrounds said area of high electrostatic field strength.

3. The shielded inductor of claim 2, wherein said magnetic circuit comprises a substantially continuous loop of a ferromagnetic material and an air gap therein, and said first magnetic shield surrounds the portion of the magnetic circuit having the air gap therein.

4. The shielded inductor of claim 2, wherein said winding assembly includes a plurality of windings.

5. The shielded inductor of claim 1, wherein said first and second loops of said magnetic circuit having a total net flux of zero.

* * * * *